US010155404B2

(12) United States Patent
Ishikawa

(10) Patent No.: US 10,155,404 B2
(45) Date of Patent: Dec. 18, 2018

(54) LIQUID DISCHARGING APPARATUS

(71) Applicant: SEIKO EPSON CORPORATION, Tokyo (JP)

(72) Inventor: Yugo Ishikawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/615,194

(22) Filed: Jun. 6, 2017

(65) Prior Publication Data

US 2017/0355207 A1 Dec. 14, 2017

(30) Foreign Application Priority Data

Jun. 9, 2016 (JP) ..... 2016-115559

(51) Int. Cl.
*B41J 2/14* (2006.01)
*B41J 29/377* (2006.01)
*B41J 25/00* (2006.01)

(52) U.S. Cl.
CPC ..... *B41J 25/006* (2013.01); *B41J 2/1433* (2013.01); *B41J 29/377* (2013.01)

(58) Field of Classification Search
CPC ..... B41J 29/377; B41J 2/1433
See application file for complete search history.

(56) References Cited

FOREIGN PATENT DOCUMENTS

| | | |
|---|---|---|
| EP | 2789463 | 10/2014 |
| JP | 2013-120861 | 6/2013 |

*Primary Examiner* — Jason S Uhlenhake
(74) *Attorney, Agent, or Firm* — Workman Nydegger

(57) ABSTRACT

A printing apparatus includes a discharging unit configured to discharge ink on a medium; a drive circuit configured to drive the discharging unit; a carriage configured to reciprocate in a scanning direction X while supporting the discharging unit and the drive circuit; and a blowing unit capable of blowing air toward the drive circuit supported on the carriage. The carriage includes a shielding member that partitions a discharging unit housing room from a drive circuit housing room. The discharging unit is disposed in the discharging unit housing room, and the drive circuit is disposed in the drive circuit housing room.

8 Claims, 5 Drawing Sheets

LIQUID DISCHARGING APPARATUS

BACKGROUND

1. Technical Field

The present invention relates to a liquid discharging apparatus such as an ink jet printer.

2. Related Art

In the related art, printing apparatuses are known that are provided with discharging units (heads) configured to discharge ink, a drive circuit (head driver integrated circuit) configured to drive the discharging units, and a carriage supporting the discharging units and the drive circuit. Such printing apparatuses print by discharging ink from the discharging units toward a medium such as a sheet while the carriage moves in a scanning direction.

Among such printing apparatuses, there are also printing apparatuses in which the discharging units and the drive circuit are disposed within the carriage, and a fan is provided on the carriage (e.g. JP-A-2013-120861). With such a printing apparatus, gas is circulated within the carriage by the driving of the fan and, as a result, rises in temperature within the carriage caused by heat generated in the drive circuit are suppressed.

However, with printing apparatuses such as those described above, the discharging units and the drive circuit are disposed within the carriage and, consequently, even if gas is circulated within the carriage, the discharging units may be heated by gas which has been heated by heat generated in the drive circuit. In this case, discharge defects of the liquid may occur due to rises in the temperature of the discharging units. Additionally, this problem is not limited to printing apparatuses, but rather is generally common to liquid discharging apparatuses in which a discharging unit and a drive circuit are disposed in a carriage that moves in a scanning direction.

SUMMARY

Hereinafter, a description is given of the means for solving the problem and the advantages of the means. To solve the problem described above, a liquid discharging apparatus includes a discharging unit configured to discharge liquid on a medium; a drive circuit configured to drive the discharging unit; a carriage configured to reciprocate in a scanning direction while supporting the discharging unit and the drive circuit; and a blowing unit capable of blowing air toward the drive circuit supported on the carriage. In such a liquid discharging apparatus, the carriage includes a shielding member partitioning a first region from a second region. The discharging unit is disposed in the first region, and the drive circuit is disposed in the second region.

In this case, the shielding member is provided that partitions the first region from the second region, and the discharging unit is disposed in the first region, and the drive circuit is disposed in the second region. As such, heat is less likely to be transferred from the drive circuit to the discharging unit. Additionally, because the shielding member is provided, gas blown from the blowing unit toward the drive circuit and heated by heat generated in the drive circuit (high temperature gas) is less likely to flow into the first region in which the discharging unit is disposed. Thus, rises in temperature of the discharging unit caused by heat generated in the drive circuit can be suppressed. Additionally, the occurrence of discharge defects of the liquid due to rises in the temperature of the discharging unit can be suppressed.

It is preferable that the carriage includes a connector that electrically connects the discharging unit to the drive circuit; and the connector is provided on the shielding member and is exposed in the first region and the second region.

For example, a communication hole that allows communication between the first region and the second region may be formed in the shielding member, and wiring that connects the discharging unit to the drive circuit may be passed through this communication hole. In such a case, a gap is likely to be created between the communication hole and the wiring. Consequently, high temperature gas is likely to flow from the second region to the first region through the gap between the communication hole and the wiring.

In contrast, with the configuration described above, the connector is provided on the shielding member and the discharging unit is connected to the drive circuit via the connector. As such, a gap is less likely to be created between the connector and the shielding member. Accordingly, the high temperature gas is less likely to flow from the second region to the first region through a gap between the connector and the shielding member and, thus, rises in temperature of the discharging unit can be suppressed.

It is preferable that the carriage includes side walls covering both sides in the scanning direction of the first region; and ventilation holes penetrating in the scanning direction are formed in the side walls.

In this case, the first region, the discharging unit being disposed in the first region, is covered by the side walls in the scanning direction. As such, gas blown toward the drive circuit is less likely to circumvent the shielding member and reach the first region. On the other hand, the ventilation holes are formed in the side walls provided on both sides of the first region. As such, gas can be passed into the first region when the carriage reciprocates in the scanning direction. Thus, rises in the temperature of the discharging unit can be suppressed and the discharging unit can be cooled.

It is preferable that the liquid discharging apparatus further includes a transport unit configured to transport the medium in a transport direction. In this case, the drive circuit is preferably disposed in the carriage farther upstream in the transport direction than the discharging unit; and the carriage preferably includes a guide portion configured to direct gas blown toward the drive circuit upstream in the transport direction.

In this case, the gas blown toward the drive circuit is directed to flow upstream in the transport direction by the guide portion. Additionally, in this case, the drive circuit is disposed farther upstream in the transport direction than the discharging unit. As such, the gas directed by the guide portion is less likely to flow toward the discharging unit. Thus, because the gas that has been heated by heat generated in the drive circuit is less likely to flow toward the discharging unit, rises in the temperature of the discharging unit can be suppressed.

It is preferable that the shielding member is constituted from a heat insulating material. In this case, heat is less likely to transfer through the shielding member from the second region to the first region. The drive circuit is disposed in the second region, and the discharging unit is disposed in the first region. Accordingly, rises in the temperature of the discharging unit caused by heat generated in the drive circuit transmitting through the shielding member can be suppressed.

BRIEF DESCRIPTION OF THE DRAWINGS

The invention will be described with reference to the accompanying drawings, wherein like numbers reference like elements.

DESCRIPTION OF EMBODIMENTS

An exemplary embodiment of a printing apparatus is described below while referencing the accompanying drawings. Note that the liquid discharging apparatus of the present exemplary embodiment is an ink jet printing apparatus that forms characters and images by discharging liquid, an example thereof being ink, onto a medium such as a sheet.

Figure 1:
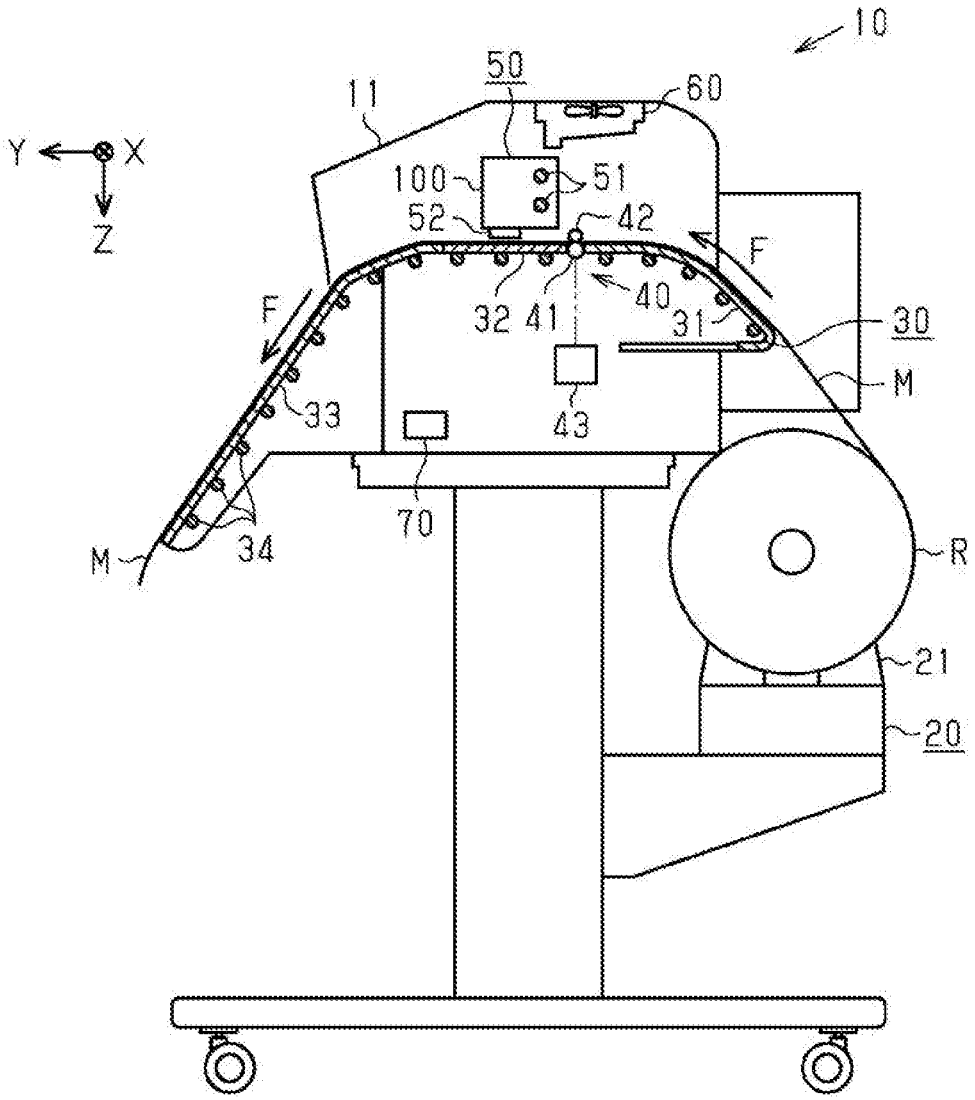
FIG. 1 is a side view of a printing apparatus according to an exemplary embodiment.

As illustrated in FIG. 1, a printing apparatus 10 is provided with a feeding unit 20 that feeds a medium M, a support unit 30 that supports the medium M, a transport unit 40 that transports the medium M, a printing unit 50 that prints on the medium M, a blowing unit 60 that blows gas toward the printing unit 50, and a control unit 70 that controls these constituents.

In the following description, a width direction of the printing apparatus 10 is referred to as a "scanning direction X", a front-back direction of the printing apparatus 10 is referred to as a "front-back direction Y", a vertical direction of the printing apparatus 10 is referred to as a "vertical direction Z", and a direction in which the medium M is transported is referred to as a "transport direction F." The scanning direction X, the front-back direction Y, and the vertical direction Z are directions that cross (are orthogonal to) each other, and the transport direction F is a direction that crosses (is orthogonal to) the scanning direction X.

The feeding unit 20 includes a holding member 21 that rotatably holds a roll R on which the medium M is wound. The holding member 21 holds different types of media M and rolls R with different dimensions in the scanning direction X. Moreover, the medium M is unwound from the roll R and fed toward the support unit 30 by rotating the roll R in one direction (the counter-clockwise direction in FIG. 1) at the feeding unit 20.

The support unit 30 is provided with, from upstream toward downstream in the transport direction F, a first support member 31, a second support member 32, and a third support member 33. These constituents form the transport path of the medium M. The first support member 31 guides the medium M fed from the feeding unit 20 toward the second support member 32, the second support member 32 supports the medium M on which printing is to be performed, and the third support member 33 guides the medium M on which printing has been performed downstream in the transport direction F.

A heating unit 34 that heats the first support member 31, the second support member 32, and the third support member 33 is provided on the side opposite the side of the transport path of the medium M at the first support member 31, the second support member 32, and the third support member 33. The heating unit 34 is provided to heat the medium M via the first support member 31, the second support member 32, and the third support member 33. The heating unit 34 may be constituted from heating wire or the like, for example.

The transport unit 40 is provided with a transport roller 41 that imparts transporting force to the medium M, a driven roller 42 that presses the medium M against the transport roller 41, and a transport motor 43 that drives the transport roller 41.

The transport roller 41 and the driven roller 42 are rollers for which axial directions are the scanning direction X. Additionally, the transport roller 41 is disposed vertically below the transport path of the medium M, and the driven roller 42 is disposed vertically above the transport path of the medium M. Moreover, the transport unit 40 transports the medium M in the transport direction F by rotating the transport roller 41 while the medium M is sandwiched between the transport roller 41 and the driven roller 42.

Figure 2:
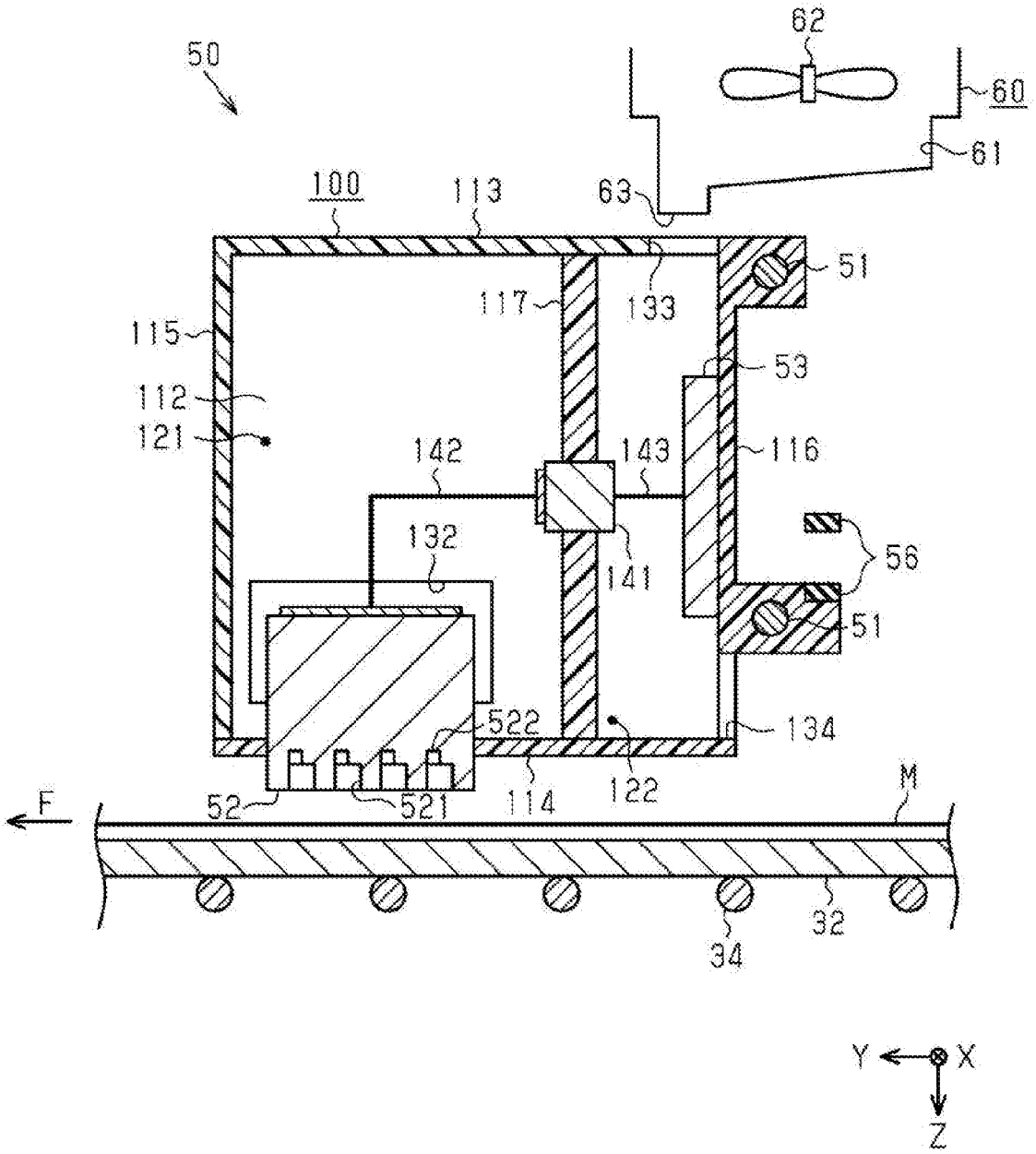
FIG. 2 is a side view of surrounding configurations of a printing unit of the printing apparatus.
Figure 3:
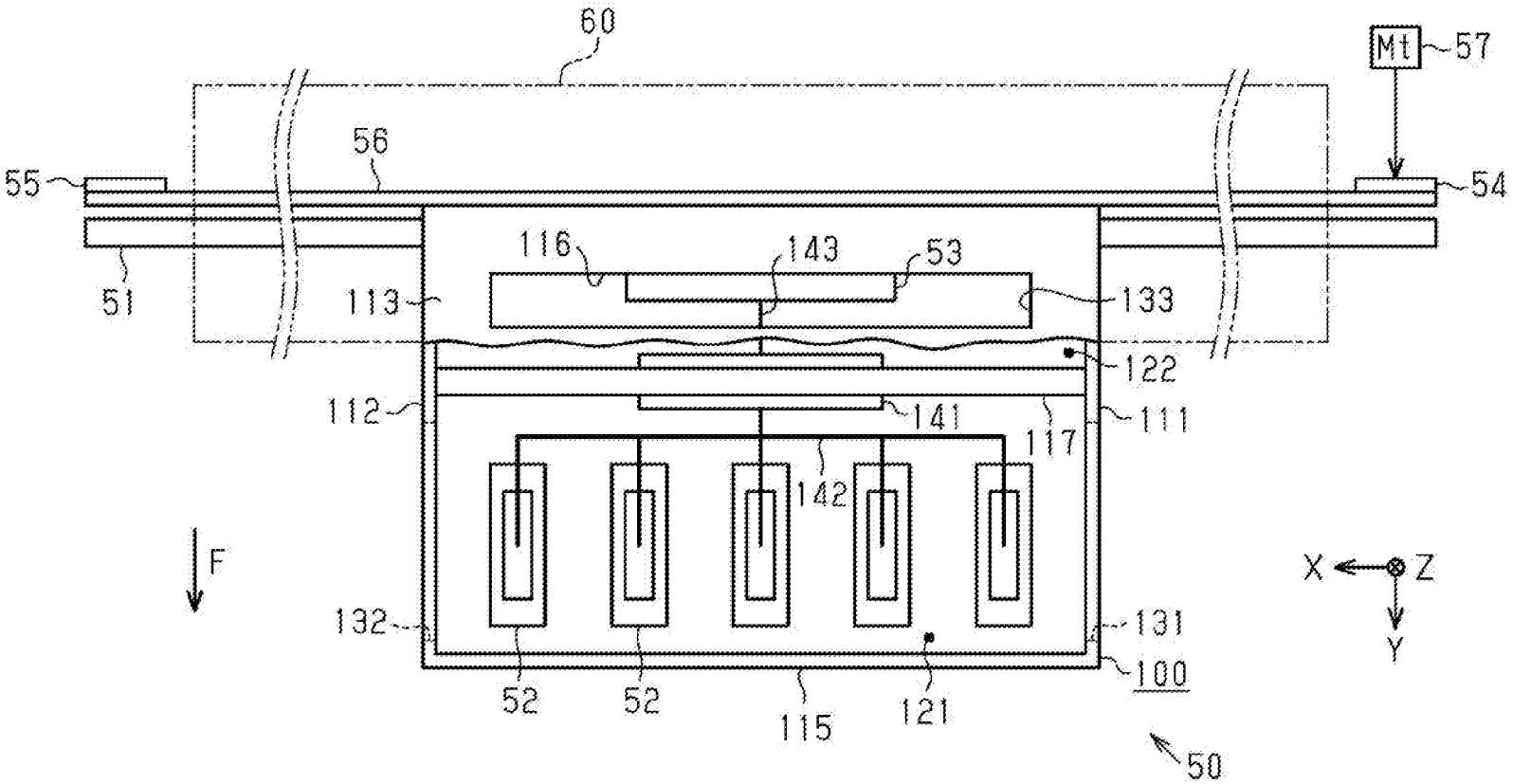
FIG. 3 is a plan view of the printing unit.

Next, a description of the printing unit 50 will be given while referencing FIG. 1 to FIG. 3. As illustrated in FIG. 1 to FIG. 3, the printing unit 50 is provided with guide shafts 51 for which an axial direction is the scanning direction X, discharging units 52 that discharge liquid, an example thereof being ink, onto the medium M, a drive circuit 53 that drives the discharging units 52, and a carriage 100 that reciprocates in the scanning direction X while supporting the discharging units 52 and the drive circuit 53. Additionally, as illustrated in FIG. 3, the printing unit 50 is provided with a drive pulley 54 provided on a first edge side in the scanning direction X, a driven pulley 55 provided on a second edge side in the scanning direction X, a timing belt 56 wound on the drive pulley 54 and the driven pulley 55, and a carriage motor 57 that drives the drive pulley 54.

As illustrated in FIG. 2 and FIG. 3, the carriage 100 has a substantially box shape, and includes side walls 111 and 112 that cross the scanning direction X, a top wall 113 and a bottom wall 114 that cross the vertical direction Z, a front wall 115 and a back wall 116 that cross the front-back direction Y, and a shielding member 117 provided between the front wall 115 and the back wall 116. Additionally, in the carriage 100, a discharging unit housing room 121 that houses the discharging units 52 is formed farther downstream in the transport direction F than the shielding member 117, and a drive circuit housing room 122 that houses the drive circuit 53 is formed farther upstream in the transport direction F than the shielding member 117.

On this point, in the exemplary embodiment, the discharging unit housing room 121 corresponds to an example of the "first region in which the discharging unit is disposed", and the drive circuit housing room 122 corresponds to an example of the "second region in which the drive circuit is disposed." Additionally, downstream in the transport direction F corresponds to a "first end in the transport direction F" and upstream in the transport direction F corresponds to a "second end in the transport direction F."

As illustrated in FIG. 2 and FIG. 3, the side walls 111 and 112 of the carriage 100 cover both sides in the scanning direction X of the discharging unit housing room 121 and the drive circuit housing room 122. Additionally, ventilation holes 131 and 132 penetrating in the scanning direction X are formed in the side walls 111 and 112 of the carriage 100. That is, the discharging unit housing room 121 is in communication with space outside the carriage 100 via the ventilation holes 131 and 132. Moreover, in the side view of the carriage 100 illustrated in FIG. 2, the ventilation holes 131 and 132 are formed in the vertical lower side of the side walls 111 and 112 so as to overlap with the discharging units 52.

As illustrated in FIG. 2 and FIG. 3, an intake port 133 is formed on the downstream side in the transport direction F in the top wall 113 of the carriage 100, and a discharge port 134 is formed on the vertical lower side in the back wall 116 of the carriage 100. The intake port 133 and the discharge port 134 are configured to allow communication between the drive circuit housing room 122 and space outside the carriage 100. The intake port 133 is an opening for taking gas blown from the blowing unit 60 into the drive circuit housing room 122. The discharge port 134 is an opening for discharging the gas taken into the drive circuit housing room 122 out of the carriage 100.

The guide shafts 51 are inserted through the back wall 116 in the scanning direction X, and portions of the timing belt 56 are connected to the back wall 116. Thus, the carriage 100 reciprocates in the scanning direction X along the guide shafts 51 as a result of forward rotation and reverse rotation of the timing belt 56.

As illustrated in FIG. 2 and FIG. 3, the plurality of discharging units (discharging heads) 52 are disposed side by side in the scanning direction X, on the downstream side in the transport direction F in the bottom wall 114 of the carriage 100. The plurality of discharging units 52 are disposed in a state penetrating the bottom wall 114 such that nozzles 521 that discharge ink face the medium M supported on the second support member 32. That is, in the exemplary embodiment, the drive circuit 53 is disposed farther upstream in the transport direction F than the discharging units 52.

Each of the nozzles 521 of the discharging units 52 has an actuator 522 such as a piezoelectric element driven to discharge ink. As such, with the discharging units 52, ink is discharged from a nozzle 521 by the drive circuit 53 applying voltage to the actuator 522 corresponding to a particular nozzle 521.

A connector 141 for electrically connecting the drive circuit 53 to the discharging units 52 is provided on the shielding member 117. A portion of the connector 141 is embedded in the shielding member 117 such that the connector 141 is exposed in the discharging unit housing room 121 and the drive circuit housing room 122. That is, the connector 141 is provided on the shielding member 117 without gaps in the scanning direction X and the vertical direction Z. Moreover, the discharging units 52 are connected to the connector 141 via a harness 142, and the drive circuit 53 is connected to the connector 141 via a harness 143. Thus, the discharging units 52 are electrically connected to the drive circuit 53.

The shielding member 117 is preferably constituted from a heat insulating material with low thermal conductivity in order to make it less likely for heat to be transmitted from the drive circuit housing room 122 to the discharging unit housing room 121. Examples of the heat insulating material include fibrous heat insulating materials such as glass wool, foam heat insulating materials such as urethane foam, and heat insulating materials made from other materials. Additionally, configurations are possible in which the wall surface on the drive circuit housing room 122 side of the shielding member 117 is a surface with high thermal reflectivity, the wall surface on the discharging unit housing room 121 side of the shielding member 117 is a surface with low thermal emissivity, and the like.

In the printing unit 50, the carriage motor 57 is driven and, as a result, the drive pulley 54 rotates and the timing belt 56 wound on the drive pulley 54 and the driven pulley 55 rotates. Next, the carriage 100 connected to the timing belt 56 moves in a longitudinal direction, that is, the scanning direction X, of the guide shafts 51 and a discharge operation is performed in which the discharging units 52 discharge ink toward the medium M. Thus, one pass of printing on the medium M is performed in the printing unit 50.

As illustrated in FIG. 1 and FIG. 2, the blowing unit 60 includes a duct 61 that allows communication between space inside a housing 11 and space outside the housing 11, and a blowing fan 62 provided in the duct 61. As illustrated in FIG. 2 and FIG. 3, the duct 61 is provided throughout the scanning direction X of the printing apparatus 10. Additionally, the duct 61 includes a blowing port 63 that opens toward a movement region of the carriage 100, and is located in a region that overlaps the second support member 32 in the scanning direction X.

Thus, as illustrated in FIG. 2, when the carriage 100 has moved into the region overlapping the blowing unit 60 in the scanning direction X, the blowing port 63 of the blowing unit 60 and the intake port 133 of the carriage 100 will face each other. As such, the blowing unit 60 can blow gas toward the carriage 100 (drive circuit 53) reciprocating in the scanning direction X vertically above the second support member 32.

The control unit 70 controls the driving of the printing unit 50 and the like when a print job is received from a terminal (not illustrated in the drawings), and causes printing to be performed on the medium M. Specifically, the control unit 70 causes printing to be performed on the medium M by causing a transport operation, in which the medium M is transported by the transport unit 40 a unit transport amount in the transport direction F, and a discharge operation by the printing unit 50 to be alternately performed. Additionally, when causing printing to be performed on the medium M, the control unit 70 drives the blowing fan 62 and causes gas to be blown on the reciprocation region of the carriage 100. As a result, the ink mist produced when the discharging units 52 discharge ink toward the medium M is discharged out of the housing 11 by the air flow generated by the blowing fan 62.

Next, a description of the operation of the printing apparatus 10 of the exemplary embodiment will be given while referencing FIG. 4 and FIG. 5. Note that the solid arrows in FIG. 4 and FIG. 5 indicate the flow of gas in the housing 11.

In the printing apparatus 10, when the printing apparatus 10 prints on the medium M, the transport operation, in which the medium M is transported, and the discharge operation, in which ink is discharged onto the medium M are alternately performed. In the discharge operation, voltage is applied to the actuators 522 in order to discharge ink from the nozzles 521 of the discharging units 52. As such, heat is generated in the drive circuit 53 and the temperature in the drive circuit housing room 122 is likely to rise.

Figure 4:
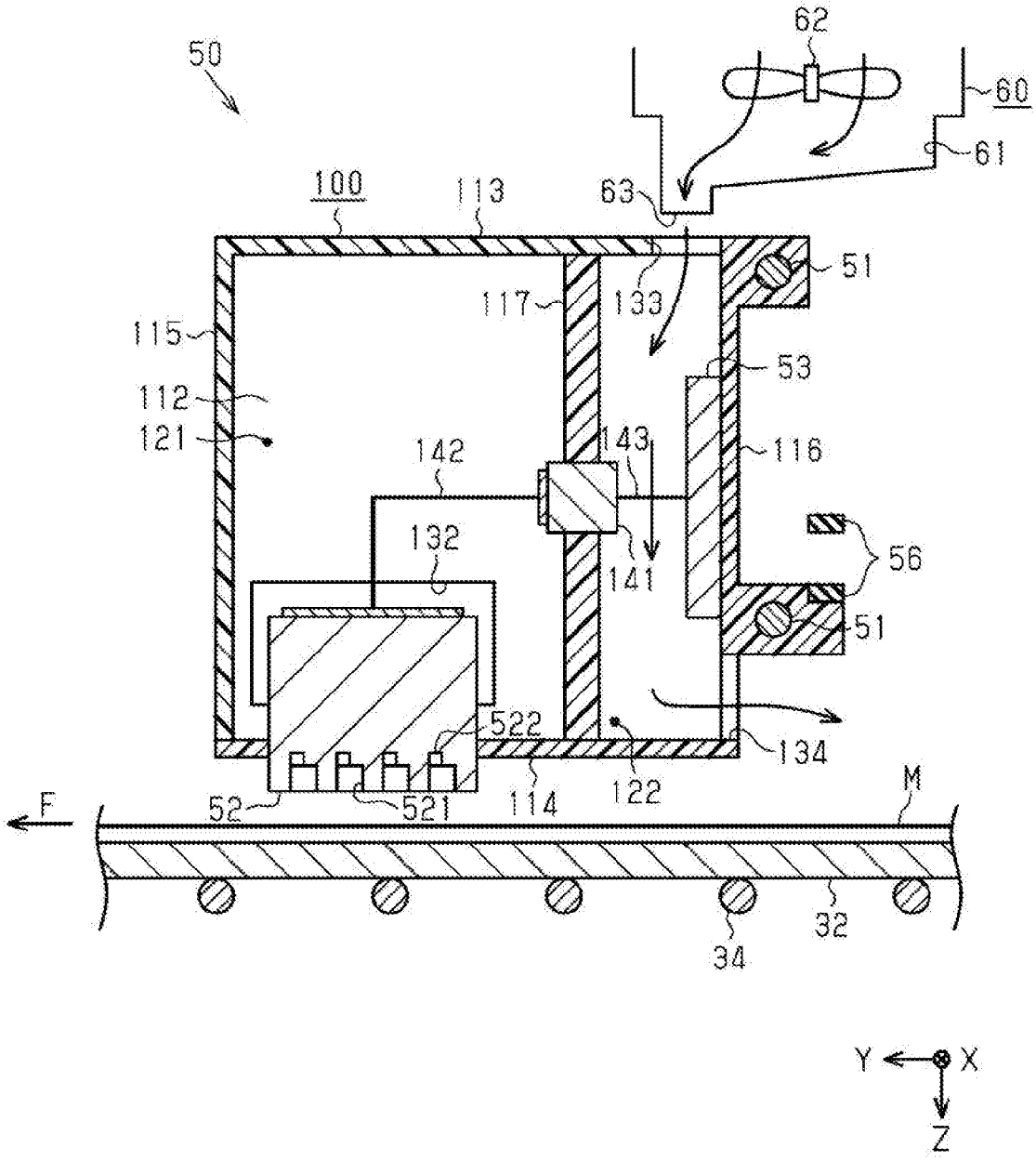
FIG. 4 is a side view of surrounding configurations of the printing unit, while printing.

On this point, as illustrated in FIG. 4, according to the exemplary embodiment, the gas blown from the blowing unit 60 toward the reciprocation region of the carriage 100 is taken into the drive circuit housing room 122 through the intake port 133 of the carriage 100 that reciprocates in the scanning direction X, and cools the drive circuit 53 in which heat has been generated. Additionally, the gas used to cool the drive circuit 53 is discharged out of the drive circuit housing room 122 through the discharge port 134. Thus, the gas taken in from outside the housing 11 will continually pass through the drive circuit housing room 122 and, as a result, rises in the temperature of the drive circuit housing room 122 caused by heat generated in the drive circuit 53 are suppressed.

The drive circuit housing room 122 is partitioned from the discharging unit housing room 121 by the shielding member 117, which has heat insulating properties. As such, heat is less likely to transfer from the drive circuit housing room 122 to the discharging unit housing room 121 and, also, the gas taken into the drive circuit housing room 122 is prevented from flowing into the discharging unit housing room 121.

Furthermore, the discharge port 134 provided in the drive circuit housing room 122 faces upstream in the transport direction F and, as such, the gas taken into the drive circuit housing room 122, that is, the gas blown toward the drive circuit 53, is discharged from the carriage 100 upstream in the transport direction F. As such, the gas discharged from the drive circuit housing room 122 is less likely to flow into the discharging unit housing room 121, which is provided farther downstream in the transport direction F than the drive circuit housing room 122. That is, rises in the temperature of the discharging units 52, caused by high temperature gas discharged from the drive circuit housing room 122 flowing into the discharging unit housing room 121, are suppressed. Note that, in the exemplary embodiment, the discharge port 134 formed in the back wall 116 of the carriage 100 corresponds to an example of the "guide portion".

Figure 5:
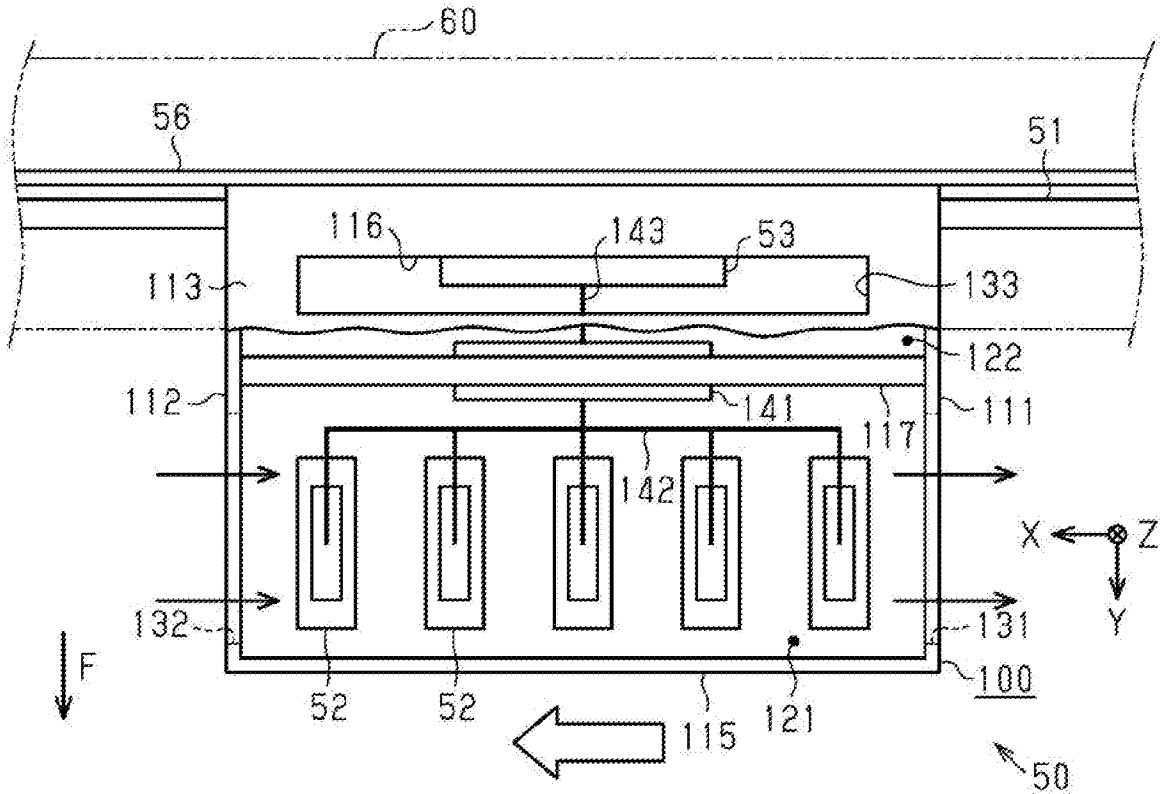
FIG. 5 is a plan view of the printing unit, while printing.

As illustrated in FIG. 5, according to the exemplary embodiment, in the discharge operation, when the carriage 100 moves in the scanning direction X, gas passes through the ventilation holes 131 and 132 formed in the side walls 111 and 112 and through the discharging unit housing room 121. Specifically, when the carriage 100 moves in the direction indicated by the hollow white arrow, as indicated by the solid arrows, gas flows into the discharging unit housing room 121 through the ventilation hole 132 formed in the side wall 112 on the leading side in the movement direction of the carriage 100, and gas flows out of the discharging unit housing room 121 through the ventilation hole 131 formed in the side wall 111 on the trailing side in the movement direction of the carriage 100. As such, even if the temperature of the discharging units 52 becomes higher than the temperature of the reciprocation region of the carriage 100, the discharging units 52 can be cooled by the gas passing through the discharging unit housing room 121.

Thus, according to the printing apparatus 10 of the exemplary embodiment, rises in the temperature of the discharging units 52, caused by heat generated in the drive circuit 53 when printing, are suppressed. According to the exemplary embodiment described above, the following advantageous effects can be obtained.

(1) The shielding member 117 partitioning the discharging unit housing room 121 in which the discharging units 52 are disposed from the drive circuit housing room 122, in which the drive circuit 53 is disposed, is provided in the carriage 100. As such, heat can be made less likely to transfer from the drive circuit housing room 122 to the discharging unit housing room 121. Additionally, because the shielding member 117 is provided, gas blown from the blowing unit 60 toward the drive circuit 53 and heated by heat generated in the drive circuit 53 (high temperature gas), is less likely to flow into the discharging unit housing room 121. As such, rises in the temperature of the discharging units 52 caused by heat generated in the drive circuit 53 can be suppressed and the occurrence of discharge defect of ink in the discharging units 52 can be suppressed.

(2) For example, a communication hole that allows communication between the discharging unit housing room 121 and the drive circuit housing room 122 may be formed in the shielding member 117, and wiring that connects the discharging units 52 to the drive circuit 53 may be passed through this communication hole. In such a case, a gap is likely to be created between the communication hole and the wiring. Consequently, high temperature gas is likely to flow from the drive circuit housing room 122 to the discharging unit housing room 121 through the gap between the communication hole and the wiring.

In contrast, with the exemplary embodiment described above, the connector 141 is provided on the shielding member 117, and the discharging units 52 are connected to the drive circuit 53 via the connector 141. As such, a gap is less likely to be created between the connector 141 and the shielding member 117. Accordingly, the flow of high temperature gas from the drive circuit housing room 122 into the discharging unit housing room 121, which is the first region, through gaps between the connector 141 and the shielding member 117 can be suppressed. Thus, even when the discharging units 52 is connected to the drive circuit 53 through the shielding member 117, rises in the temperature of the discharging units 52 caused by heat generated in the drive circuit 53 can be suppressed.

(3) The side walls 111 and 112 cover, in the scanning direction X, the discharging unit housing room 121 in which the discharging units 52 are disposed. As such, gas blown toward the drive circuit 53 is prevented from circumventing the shielding member 117 and flowing into the discharging unit housing room 121. Additionally, the ventilation holes 131 and 132 are formed in the side walls 111 and 112 provided on both sides of the discharging unit housing room 121. As such, when the carriage 100 reciprocates in the scanning direction X, gas can pass through the discharging unit housing room 121 and cool the discharging units 52.

(4) The discharge port 134 whereby gas is discharged from the drive circuit housing room 122 is provided in the back wall 116. As such, the gas discharged from the drive circuit housing room 122 flows upstream in the transport direction F from the carriage 100. Additionally, in the exemplary embodiment, the drive circuit 53 is disposed farther upstream in the transport direction F than the discharging units 52. As such, the gas discharged from the discharge port 134 is less likely to flow toward the discharging units 52. Thus, rises in the temperature of the discharging units 52 can be suppressed an amount corresponding to the degree that the gas that has been heated by heat generated in the drive circuit 53 is less likely to flow toward the discharging units 52.

(5) The shielding member 117 is constituted from the heat insulating material. As such, heat can be made less likely to transfer through the shielding member 117 from the drive circuit housing room 122, in which the drive circuit 53 is disposed, to the discharging unit housing room 121, in which the discharging units 52 are disposed.

(6) Compared to a case where the blowing fan 62 is mounted on the carriage 100, vibration occurring as a result of the driving of the blowing fan 62 is prevented from being transmitted to the carriage 100. As such, the impact of the driving of the blowing fan 62 on the discharge mode and landing accuracy of the ink of the discharging units 52 can be reduced.

The exemplary embodiment described above may be modified as follows.

The connector 141 need not be provided on the shielding member 117. In this case, a communication hole is preferably formed in the shielding member 117, and the harness connecting the discharging units 52 to the drive circuit 53 is preferably passed through this communication hole.

The ventilation holes 131 and 132 need not be formed in the side walls 111 and 112 of the carriage 100, and the side walls 111 and 112 of the carriage 100 need not be provided.

The discharging units 52 may be disposed in the carriage 100 farther upstream in the transport direction F than the drive circuit 53. In this case, the discharge port 134 is preferably provided so that the gas taken into the drive circuit housing room 122 can be discharged downstream in the transport direction F. That is, in this case, upstream in the transport direction F corresponds to a "first end in the transport direction F" and downstream in the transport direction F corresponds to a "second end in the transport direction F."

The discharge port 134 for discharging gas from the drive circuit housing room 122 may be formed in the side walls 111 and 112 of the carriage 100, or may be formed in the bottom wall 114 of the carriage 100. That is, the discharge port 134 need not discharge the gas blown toward the drive circuit 53 upstream in the transport direction F.

The drive circuit 53 may be attached on the outer side of the carriage 100, for example, on the upstream side in the transport direction F of the back wall 116 of the carriage 100. In this case, the back wall 116 of the carriage 100 functions as the shielding member 117. Additionally, in this case, a guide plate (example of the guide portion) is preferably provided that directs the gas blown toward the drive circuit 53 upstream in the transport direction F. Note that the guide plate in this case preferably has a length in the scanning direction X substantially the same as that of the discharge port 134, and is a plate extending upstream in the transport direction F.

The transport unit 40 need not be provided. In this case, the printing apparatus 10 prints on a medium M that has a strip-shape, and for which the longitudinal direction is the scanning direction X.

The shielding member 117 need not completely partition the discharging unit housing room 121 from the drive circuit housing room 122. That is, partial communication between the discharging unit housing room 121 and the drive circuit housing room 122 may exist.

The shielding member 117 need not be constituted from an insulating material that has high heat insulating properties. For example, the shielding member 117 may be constituted from the same material as the side walls 111 and 112 of the carriage 100.

The connector 141 may be provided protruding from the shielding member 117 into the discharging unit housing room 121 and the drive circuit housing room 122, or may be recessed in the shielding member 117.

The discharging units 52 may be configured to be detachable and replaceable. In this case, the discharging units 52 are connected to the drive circuit 53 via the connector 141 and the harness 142. As such, because the discharging units 52 can be removed from the drive circuit 53, the discharging units 52 can be easily replaced.

In addition to a sheet, the medium M may be fiber, leather, plastic, wood, and ceramic.

Other than a medium M unwound from the roll R, the medium M may be a cutform medium M or a simple long medium M.

The liquid discharged or sprayed from the discharging units 52 is not limited to ink and, for example, may be a liquid material obtained by dispersing or mixing particles of a functional material in liquid, or the like. For example, a configuration is possible in which a liquid material, which includes material such as an electrode material, or a color material (pixel material) used in the manufacture of liquid crystal displays, electroluminescence (EL) displays, surface emitting displays, and the like in a dispersed or dissolved form, is discharged for recording.

Technical concepts understood from the exemplary embodiment are described below. A liquid discharging apparatus includes a discharging unit configured to discharge liquid onto a medium; a drive circuit configured to drive the discharging unit; a carriage configured to reciprocate in a scanning direction while supporting the discharging unit and the drive circuit; a transport unit configured to transport the medium in a transport direction; and a blowing unit capable of blowing air toward the drive circuit supported on the carriage. Moreover, the drive circuit is disposed in the carriage farther to a second end side in the transport direction than the discharging unit; and the carriage includes a guide portion configured to direct gas blown toward the drive circuit toward the second end side in the transport direction.

In this case, the gas blown toward the drive circuit and heated to a high temperature by heat generated in the drive circuit is directed to flow to the side (the second end side in the transport direction) opposite the side where the discharging unit is disposed (the first end side in the transport direction) by the guide portion. As such, the high temperature gas directed by the guide portion is less likely to flow toward the discharging unit, and rises in the temperature of the discharging unit caused by heat generated in the drive circuit can be suppressed.

This application claims priority under 35 U.S.C. § 119 to Japanese Patent Application No. 2016-115559, filed Jun. 9, 2016. The entire disclosure of Japanese Patent Application No. 2016-115559 is hereby incorporated herein by reference.

What is claimed is:

1. A liquid discharging apparatus, comprising:

a discharging unit configured to discharge liquid on a medium;

a drive circuit configured to drive the discharging unit;

a carriage configured to reciprocate in a scanning direction while supporting the discharging unit and the drive circuit; and a blowing unit capable of blowing air toward the drive circuit supported on the carriage;

wherein the carriage includes a shielding member partitioning a first region from a second region, wherein the discharging unit is disposed in the first region, and the drive circuit is disposed in the second region, wherein the carriage includes a connector that electrically connects the discharging unit to the drive circuit; and wherein the connector is provided on the shielding member and is exposed in the first region and the second region.

2. The liquid discharging apparatus according to claim 1, wherein:

the carriage includes side walls covering both sides in the scanning direction of the first region; and ventilation holes penetrating in the scanning direction are formed in the side walls.

3. The liquid discharging apparatus according to claim 2, further comprising;

a transport unit configured to transport the medium in a transport direction; wherein the drive circuit is disposed in the carriage farther upstream in the transport direction than the discharging unit; and the carriage includes a guide portion configured to direct gas blown toward the drive circuit upstream in the transport direction.

4. The liquid discharging apparatus according to claim 3, wherein:

the shielding member is constituted from a heat insulating material.

5. The liquid discharging apparatus according to claim 2, wherein:

the shielding member is constituted from a heat insulating material.

6. The liquid discharging apparatus according to claim 1, further comprising;

a transport unit configured to transport the medium in a transport direction; wherein the drive circuit is disposed in the carriage farther upstream in the transport direction than the discharging unit; and the carriage includes a guide portion configured to direct gas blown toward the drive circuit upstream in the transport direction.

7. The liquid discharging apparatus according to claim 6, wherein:

the shielding member is constituted from a heat insulating material.

8. The liquid discharging apparatus according to claim 1, wherein:

the shielding member is constituted from a heat insulating material.

* * * * *